US005709256A

United States Patent [19]

Thormeier

[11] Patent Number: 5,709,256

[45] Date of Patent: Jan. 20, 1998

[54] WORKBENCH, IN PARTICULAR AS A TEACHING AID IN THE FORM OF AN ERGONOMICALLY DESIGNED MULTIPURPOSE WORKBENCH

[76] Inventor: Klaus Haus Thormeier, Ackerstrasse 37, D-51519 Odenthal, Germany

[21] Appl. No.: 535,274

[22] PCT Filed: Mar. 31, 1994

[86] PCT No.: PCT/DE94/00377

§ 371 Date: Oct. 10, 1995

§ 102(e) Date: Oct. 10, 1995

[87] PCT Pub. No.: WO94/23908

PCT Pub. Date: Oct. 27, 1994

[30] Foreign Application Priority Data

Apr. 10, 1993 [DE] Germany ..... 43 11 965.4

[51] Int. Cl.[6] ..... B25N 1/00

[52] U.S. Cl. ..... 144/286.1; 144/307; 269/900

[58] Field of Search ..... 269/291, 292, 269/293, 294, 900, 901; 144/286.1, 286.5, 306, 307

[56] References Cited

U.S. PATENT DOCUMENTS

| | | | |
|---|---|---|---|
| 537,338 | 4/1895 | Brown | 144/307 |
| 1,205,884 | 11/1916 | Gorlitz | 144/286.1 |
| 1,508,979 | 9/1924 | Keller | 144/286.1 |
| 1,596,169 | 8/1926 | Follmer | 144/307 |
| 2,437,351 | 3/1948 | Follmer | 144/307 |
| 2,587,177 | 2/1952 | Larson | 144/286.1 |
| 4,375,827 | 3/1983 | Ignjatic | 144/286.1 |
| 5,186,228 | 2/1993 | Stafford | 269/900 |
| 5,553,838 | 9/1996 | Lee | 269/900 |

FOREIGN PATENT DOCUMENTS

| | | | |
|---|---|---|---|
| 0098101 | 1/1984 | European Pat. Off. . | |
| 192703 | 5/1906 | Germany . | |
| 186995 | 7/1907 | Germany | 144/286.1 |
| 75997 | 10/1917 | Germany | 144/286.1 |
| 442519 | 4/1927 | Germany | 144/286.1 |
| 1910946 | 9/1970 | Germany | 144/286.1 |
| 81 06 245 | 10/1981 | Germany . | |
| 114327 | 3/1926 | Switzerland . | |
| 144071 | 2/1931 | Switzerland . | |
| 210534 | 2/1924 | United Kingdom | 144/286.1 |
| 2228705 | 9/1990 | United Kingdom . | |

OTHER PUBLICATIONS

Fine Woodworking, No. 83, Aug. 1990, Newton CT p. 16, "Improved Benchdog".

*Primary Examiner*—W. Donald Bray
*Attorney, Agent, or Firm*—Collard & Roe, P.C.

[57] ABSTRACT

A workbench which is to be used especially as a teaching aid in the form of an ergonomically designed multi-purpose workbench for use in handicraft training is to have vice work stations which can easily be converted for left or right-handed people. In particular, it is to be possible for work stations for left and right-handers easily to be arranged on one and the same workbench. This is achieved by a vice which can be clamped to the worktop of the workbench via a spindle fitted centrally on the vice. The centric spindle arrangement makes it easy to convert the vices for right and left-handed operations via spindle supports arranged on both sides on the corner of the workbench or work station. The vices are turned simply by rotation through 180°. In addition, suitably distributed apertures to take bench clamps for the vices facilitate zero or low-torque three-point clamping of workpieces. Auxiliary tools can easily be fitted and secured on the workbench.

14 Claims, 2 Drawing Sheets

Fig. 2a
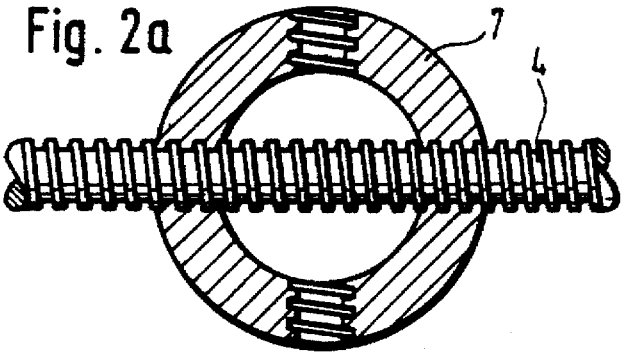
Fig. 3
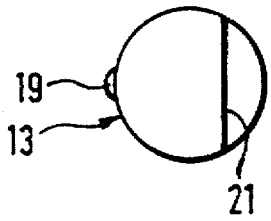
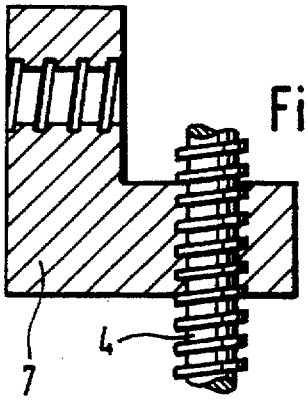
Fig. 2b
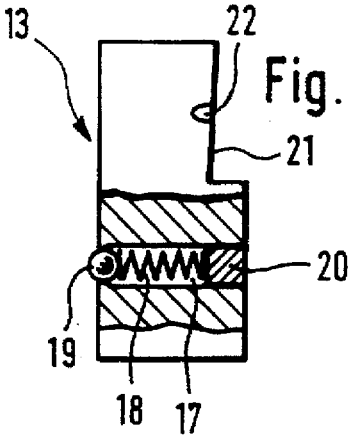
Fig. 4

WORKBENCH, IN PARTICULAR AS A TEACHING AID IN THE FORM OF AN ERGONOMICALLY DESIGNED MULTIPURPOSE WORKBENCH

The invention relates to a workbench, in particular as a teaching aid in the form of an ergonomically designed multipurpose workbench for use in training for practical trades, according to the preamble of patent claim 1.

On such a workbench which is used primarily for teaching purposes, a separate workstation should be able to be provided at each corner. In this case, it should be possible to set up different workstations for left-handed and right-handed people at one and the same workbench. In workstations for right-handed and left-handed people, the vises are respectively arranged in a different manner at the corners of the worktop of the workbench. In single workstation or multiple workstation workbenches, this different arrangement previously necessitated different workbenches, respectively specifically for right-handed and/or left-handed people.

In the previously known workbenches (such as, for example, according to CH-A-114, 327; DE-C-192,703; and DE-U-8,106,245.1), one workbench always had only either exclusively workstations for right-handed people or such workstations for left-handed people. This derives from the fact that the vises for right-handed and left-handed people must be arranged in a different manner at the workbench corners. Left-handed and right-handed people therefore always had to work at separate workbenches set up respectively for them. Therefore, in order to have sufficient appropriate workstations both for left-handed and for right-handed people with the distribution ratios between left-handed and right-handed people varying from group to group or from training class to training class, generally more workbenches had to be available for use than would be necessary in the case of all the workstations being able to be occupied without taking account of the different hand bias of the trainees.

Providing an improvement here in the sense of more efficient usage of the workstations set up for right-handed and left-handed people at multiple workstation workbenches is a considerable problem with which the present invention is concerned. Furthermore, the invention aims overall to achieve optimum working from an ergonomic viewpoint at such a multiple workstation workbench by means of an appropriate workstation design relating to the workbench. Included in this objective, in particular, are also the auxiliary devices which are customarily used at the workbench such as, inter alia, the bench clamps or other auxiliary tools to be accommodated. Special attention is also paid to a simple construction of the individual functional and auxiliary devices. This applies to a particular extent to the construction and functionality of the vises.

The disadvantage of the inefficient stocking of more workstations or workbenches than would actually be required for the actual number of assigned trainees due to the use of different workbenches for left-handed and right-handed people is eliminated in a quite simple and effective manner by providing a workbench having the characterizing features of patent claim 1.

Owing to the symmetrical design and guiding of the individual vises in relation to the worktop of the workbench, the vises can be mounted in different position [sic] suitable respectively for a right-handed or left-handed person, or can be transferred to such positions if required, on one and the same workbench. When transferring a vise from one side of the corner of a workbench to the other side of the same corner, the vise is simply rotated through 180 degrees about the axis of the clamping-spindle. This is possible because the vise is of correspondingly symmetrical construction. Owing to this rotatability of the vise, the guide bushes for the guiding means additionally guiding the vise on the worktop are arranged in both vise positions with the same spacing from the relevant workbench corner.

The transferability of the vises according to the invention is possible due to receiving means provided accordingly on the worktop at each of the four corners of a workbench. The transferability of a vise can also be used in an individual case for transferring the vise to a position which is more favorable for a left-handed or right-handed person working at the workbench.

It is considered to be advantageous for the handling of the vise if the additional guiding means next to the clamping-spindle respectively has the greater spacing from the assigned workbench corner in relation to the clamping-spindle. A far greater spacing thus results—compared to conventional vise guides—in the present solution between the workbench corner and the first stirring [sic] means—seen from the workbench corner such that even quite wide parts can be clamped without difficulty.

The additional guiding means is expediently a spindle which is attached rigidly to the vise, is axially freely displaceable in the worktop, and on which a spindle nut, which can be concealed in the clamping surface of the vise, is mounted to achieve a tension balance of the vise against the worktop. By means of this measure, a simplification in terms of design is achieved to the effect that the functions of the additional vise guide and of the tension balance are combined in a single part. The tension-balance spindle is guided in the worktop so as to be axially freely displaceable solely in a cylindrical bore. In particular, no spindle nut engages on this tension-balance spindle in the worktop. The design as a spindle merely serves to clamp the spindle nut, located outside the worktop, to achieve the tension balance in relation to the worktop. Such a tension balance may be necessary in order to avoid any oblique positioning of the vise when a workpiece is being clamped in the direct workbench corner region. The combination of the functions, "guiding" and "tension balance", is only possible if the tensions balance spindle respectively has the greater spacing, according to the invention, from the relevant workbench corner in relation to the clamping-spindle axis in both possible working positions of the vise.

On the workbench of the generic type, workpieces are not only clamped between the vise itself and the adjacent worktop side face, but also between so-called bench clamps which can be mounted variably on the worktop and the vise. For this purpose, receiving openings for bench clamps are customarily provided in various distributions on the worktop and on the vise.

In a quite advantageous arrangement of these receiving openings on the worktop, these openings are circular and are respectively distributed along each guide axis of the clamping spindles, over the entire worktop length. In this case, the openings respectively have the same mutual spacing from one another which, at a maximum, also corresponds to the maximum span between the vise and the worktop.

At least one receiving opening is also arranged in the vise perpendicular to the clamping-spindle axis. Owing to such an arrangement of the receiving openings, workpieces can be clamped along the clamping-spindle axis so as to be free from torque in relation to said axis. In these cases, no tension balance on the vise is then necessary. Since the vise can be used in rotated positions, the relevant receiving opening must obviously be present on the relevant two surfaces of the vise coming to rest at the top.

The arrangement described above and the alignment of the receiving openings result in a uniform pattern of receiving openings on the worktop, one receiving opening always being flush in the axial direction with the vise in the clamping-spindle axis. The receiving openings distributed in this manner allow, in particular, a good and simple clamping, within a total of three bench clamps, of round workpieces or of workpieces with edges which are not plane-parallel. In this case, two of these bench clamps can respectively be located on the worktop and one on the vise or vice versa.

In terms of depth, the receiving openings for the bench clamps are designed in such a way that the bench clamps can be inserted into the surface of the worktop flush with the surface. This provides the advantage that virtually any flat workpieces, for example metal sheets, can be clamped without any "jamming" on the bench clamps, which otherwise project shove the workpiece surface, having to be feared during the surface processing of said workpieces. The openings for the bench clamps can be blind bores of appropriate depth or through-bores respectively having an annular step for the flush contact of the bench clamps when the latter are inserted into the worktop flush with the surface. Continuous receiving bores only having an annular shoulder as a stop for the bench clamps provide the advantage that any undesirable chips which have entered these openings drop down or can be removed downwards.

The bench clamps preferably consist of metal and have a cylindrical basic shape. In order that they can be fixed at any desired heights inside the receiving openings, the bench clamps are fitted, in the region of their cylindrical basic shape, with spring means acting radially outwards.

In a favorable design, the spring means can be accommodated in a bore penetrating the bench clamp diametrically and comprise a ball which protrudes radially out of the bore under the pressure of a helical spring. In this case, the ball can rest against an annular step within the bench-clamp bore, and the helical spring can be supported on a closure piece of the bench-clamp bore at the other end thereof.

Particularly advantageous clamping characteristics can be achieved in the bench clamps due to the fact that they have, at their one end which protrudes out of the worktop surface when a workpiece is being clamped, a flattened peripheral region which respectively extends over that height with which the bench clamp can protrude to a maximum extent out of the worktop whilst still maintaining a sufficient bearing in the receiving opening of said worktop under maximum load-bearing capacity.

The workbench according to the invention, described with all its various designs and auxiliary devices, ideally fulfils the requirements placed on a workbench in a training establishment. In this case, a quite substantial advantage consists in the fact that workstations for left-handed and right-handed people can be changed as desired and/or combined by simple transferability of the vises on one and the same workbench.

An exemplary embodiment of the invention which is to be explained in greater detail below is illustrated in the drawing, in which:

FIG. 1 shows a perspective illustration of a workbench in which the entire workbench is indicated by dot-dashed lines and one workbench corner is drawn in detail;

FIGS. 2 *a*) and *b*) each show a section through two different embodiments of a dual-function spindle nut mounted in each corner of the workbench worktop to receive the clamping-spindle in positions which are offset by 90 degrees;

FIG. 3 shows the plan view of a bench clamp;

FIG. 4 shows a longitudinal section through the bench clamp according to FIG. 3.

Figure 1:
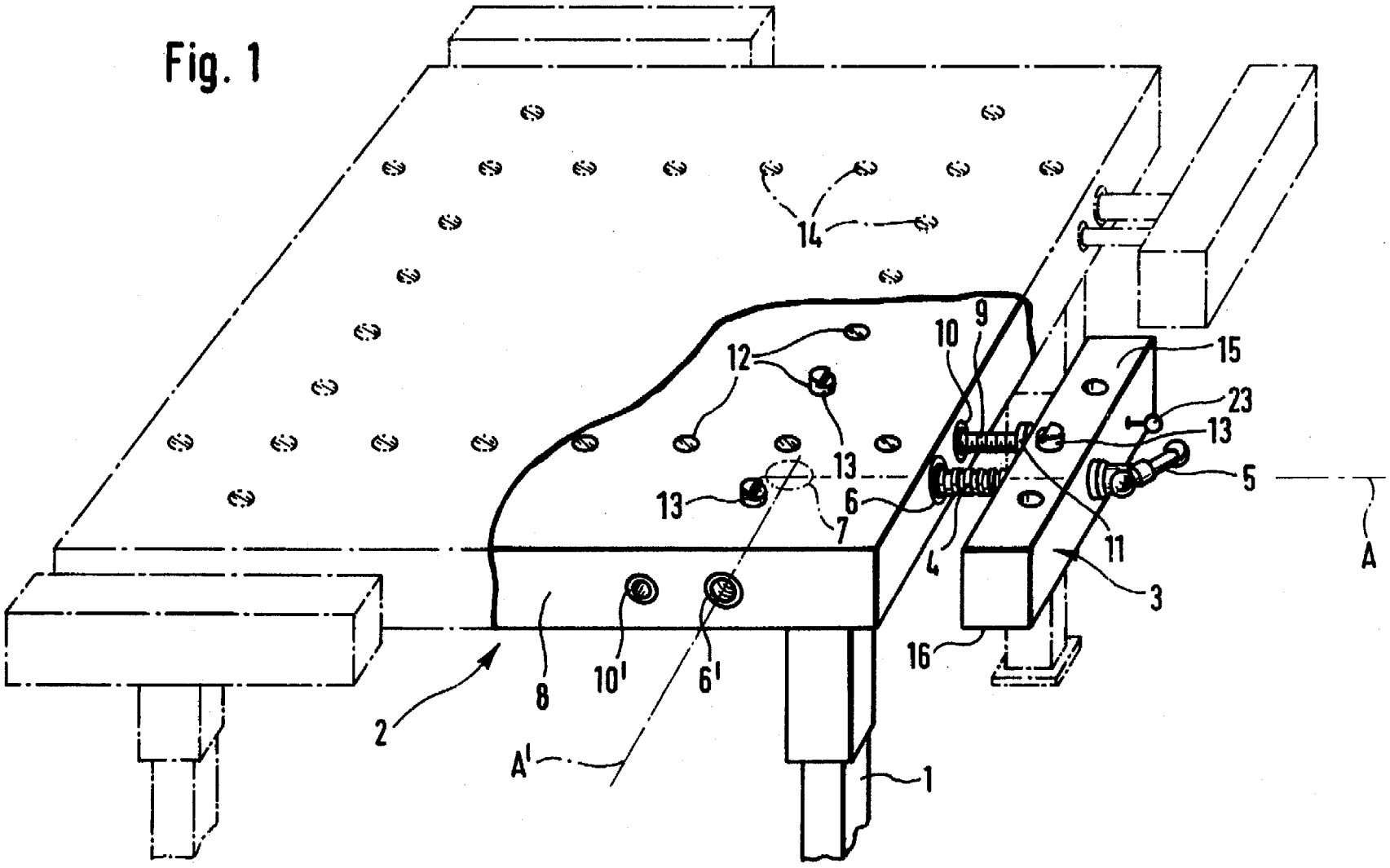

A workbench has a worktop 2, which is made of wood, for example, and is fitted onto legs 1 which are infinitely variably and centrally height-adjustable, and it is fitted with four workstations. Such multiple station workbenches are used, for example, in training establishments for all possible practical trades. Such workbenches are very well suited, inter alia, in the training of carpenters.

A vise 3 is located at each of the four workstations. Each of these vises 3 is guided and mounted in the worktop 2 by means of a clamping-spindle 4 and can be clamped against said worktop by actuating the clamping lever 5. The guiding bearing for the clamping-spindle 4 in the worktop 2 is respectively a metal bush 6. The clamping-spindle 4 is respectively mounted inside the vise 3 so as to be rotatable in an axially fixed position. The spindle nut 7 required for the longitudinal displacement of the clamping-spindle 4 is mounted in the worktop 2. Further details will be provided infra of the position of this spindle nut 7 inside the worktop at the intersection of axes A and A' as shown in FIG. 1.

The vise 3 has the shape of a cuboid which, when resting against the worktop 2, terminates on the one hand with the worktop surface and, on the other hand, with the worktop side face 8 extending perpendicular to the longitudinal extent of the cuboid, respectively flush with the surface. The clamping-spindle 4 passes through the vise 3 in the center-point of the surface of that rectangular side of said vise 3 which can be placed against the worktop 2.

Serving as guiding means for securing the vise 3 against rotation during clamping is a guide spindle 9 which is firmly connected to the vise 3 and is longitudinally displaceable in the worktop 2 in a smooth guide bush 10 provided there. Apart from serving as a vise guiding means, this spindle 9 also serves as a tension balance device in the vise. Tension balance devices which are known per se serve in vises of workbenches quite generally to avoid any oblique positioning of the vise occurring at only one end of the vise when workpieces are being clamped. In the present embodiment, this tension balance is achieved in that a spindle nut 11, which can be concealed in the vise 3 on the tension-balance spindle 9, can be clamped against the worktop 2, thus enabling any oblique positioning of the vise to be effectively avoided when a workpiece is being clamped.

The receiving means, formed by the guide bushes 6 and 10, for the clamping and tension-balance spindles 4 and 9 on the worktop 2 are respectively mounted symmetrically in pairs at each worktop corner, on each side of the corner. Of this pair of receiving means, only one is ever occupied in each case, specifically that one which is suitable for a position of the vise 3 for a left-handed or right-handed person. The insertion and transfer of the vise 3 by means of its spindles 4 and 9 is quite simple.

The attachment of the vise 3 in the spindle nut 7 of the worktop 2 can be released by actuating the clamping lever 5. The vise 3 can then easily be pulled out of the guide bushes 6 and 10. For assembly in the second pair of receiving means assigned to the relevant workbench corner and formed by the bushes 6' and 10', the vise 3 merely has to be rotated through 180 degrees, inserted and introduced into the other bearing of the vise 3 by actuating the clamping lever 5. In this way, a workstation for a left-handed or right-handed person can be set up differently, depending on requirements, at each workbench corner and can be changed again if appropriate. In FIG. 1, for example, a workbench is illustrated with two workstations for right-handed people and two workstations for left-handed people.

Cylindrical receiving openings 12 for bench clamps 13 with a cylindrical basic shape are provided on the worktop 2 respectively at equal intervals in the axial direction of the bushes 6 and 6' over the entire length of the worktop. The openings 12 can be designed as blind bores or through-bores. The depth of the blind bores is respectively matched to the height of the bench clamps 13 so that the latter terminate flush with the worktop surface when inserted completely into the opening 12. In the case of through-bores, an annular step must be provided, which fulfils the function of the base of the blind bore in relation to an insertion limitation for the bench clamps 13. In the region of a workstation, only one or two bench clamps 13 are generally respectively in use on the worktop. The other openings 12 which are not occupied by bench clamps 13 are respectively closed by loose filling pieces 14 which can be easily removed again.

At least one receiving opening 12 for a bench clamp 13 is arranged on the vise 3, on the axis of the clamping-spindle 4. By means of the arrangement of a receiving opening 12 directly above the axis of the clamping-spindle 4, clamping which is virtually free from torque is possible within the bench clamps 13 by means of the vise 3. On the worktop 2, the arrangement of the receiving openings 12 defined symmetrically to the axis of the bushes 6 and 6' is decisive for this purpose.

Apart from the opening 12 located on the axis, two further openings 12, lying symmetrically to said axis, are also provided on the vise 3. This symmetrical arrangement also serves to avoid torque when a workpiece is being clamped in three bench clamps 13. On the vise 3, the receiving openings 12 are respectively provided on the two opposite vise surfaces 15 and 16 respectively in the same distribution in order to be able to rotate the vises 3 into the different positions for workstations for left-handed and right-handed people and to use them equally.

The respectively sole dual-function spindle nut 7 of a workstation is mounted in the worktop 2 at the junction of the axes A and A' of the two bushes 6 and 6'.

The bench clamps 13 have a clamping mechanism in order to be able to be retained at any desired heights inside the openings 12. This clamping mechanism is accommodated in a bore 17 which passes diametrically through the bench clamp 13 at the foot of the bench clamp. In this case, it consists of a ball 19 which is pressed by a helical spring 18 radially outwards beyond the clamp circumference, said helical spring 18 being supported at the other end of the bore on a closure piece 20. By means of an annular step provided in the bore 17, the ball 19 cannot completely come out of the bore 17.

As a clamping surface for a workpiece to be clamped, each bench clamp 13 has a flattened region 21 in its top zone. Owing to the cylindrical basic shape of the bench clamp 13, the clamping surface can respectively be aligned flush with the countersurface of the workpiece to be clamped. In the embodiment and arrangement of the bench clamps described, in particular round workpieces and workpieces with edges which are not plane-parallel can be clamped very well.

The flattened region 21 of the bench clamps 13 is inclined slightly relative to the bench-clamp axis, specifically in such a direction that slight tilting of the bench clamp 13 is provided under clamping pressure. In this way, the clamping surface of the bench clamp 13 is aligned perpendicular to the worktop surface under pressure.

In order to be able to pull the bench clamps 13 out again when said clamps are in a state in which they are completely inserted into an opening 12 in the worktop 2, a recess 22 is respectively recessed into the flattened region 21. A bar-shaped gripping tool 23, provided with a barb at its one end, can be engaged in said recess for pulling out.

For the same purpose of removal, the filling pieces 14 are also provided on their two flat end faces with recesses for applying the same gripping tool 23. When not in use, this gripping tool 23 is stored in a receiving bore provided for this purpose in the vise 3.

I claim:

1. A workbench comprising a rectangular worktop having four intersecting side faces, and having four corners with each corner formed by two intersecting side faces, and a flat top surface with cylindrical receiving openings;

a vise provided at at least one corner of the workbench; said vise being a cuboid having a top surface level with and parallel to the flat top surface of said worktop and having a bottom surface parallel to and below said vise top surface; said vise having a first side face adjacent to and parallel to said side face of said worktop side face and said vise having a second side face parallel to said first side face of said vise;

said first side face of said vise being rectangular and having a center point; a clamping spindle having a diameter located at said center point of said first side face of said vise; an additional guide means located adjacent to said clamping spindle on said first side face of said vise;

each side face at at least one corner of said worktop having a first receiving means having a diameter for accommodating the clamping spindle and said first receiving means adjacent to a corner of said worktop; and each side face of said worktop having a second receiving means for accommodating the additional guide means and located adjacent to said first receiving means; and said first receiving means being closer to said corner of said worktop and said second receiving means being farther from said corner of said worktop;

said first receiving means and said second receiving means in each side face of said worktop being aligned symmetrically with said clamping spindle and said additional guide means, such that said vise provided at at least one corner of said workbench can be fitted into each of the two intersecting side faces of said worktop forming said corner by having the top surface of the vise for one intersecting side face of said worktop be the bottom surface of the vise by inversion thereof for another intersecting side face of said worktop.

2. Workbench according to claim 1, wherein said additional guide means has a diameter different from said spindle diameter.

3. Workbench according to claim 1, wherein said second receiving means has a diameter different from said first receiving means diameter.

4. Workbench according to claim 1, wherein the symmetrically aligned receiving means of the worktop for the vise are provided in the same manner at all four corners of the worktop.

5. Workbench according to claim 1, wherein in relation to the worktop corner, the additional guiding means between the vise and the worktop lies further away from said worktop corner than the clamping spindle.

6. Workbench according to claim 1, wherein the additional guiding means is a spindle which is attached rigidly to the vise, is axially freely displaceable in the worktop, and on which a spindle nut, which can be concealed in a clamping surface of the vise, can be clamped against the worktop to achieve a tension balance of the vise.

7. Workbench according to claim 1, comprising two spindle nuts required for the clamping-spindle first and second receiving means, respectively extending symmetrically to one another over a corner of the worktop, are respectively connected to one another to form a common part for both spindle nuts.

8. Workbench according to claim 1, comprising cylindrical receiving openings for bench clamps provided on the worktop in all axes of the clamping-spindles provided in the worktop, said openings being respectively arranged distributed over an entire worktop length.

9. Workbench according to claim 1, wherein the receiving openings provided in the worktop for bench clamps respectively have a same spacing from one another in one row.

10. Workbench according to claim 1, wherein on said vise top surface and on said vise bottom surface which may come to rest in the worktop plane depending on the position of the vise, each vise is provided with at least one receiving opening, lying vertically above an axis of the clamping-spindle, for a bench clamp.

11. Workbench according to claim 10, having a plurality of receiving openings for bench clamps respectively in the vise surfaces, wherein these openings are arranged in the same distribution on each of the vise top surface and the vise bottom surface.

12. Workbench according to claim 1, wherein the bench clamps are of metal, and have a cylindrical shape and have radially acting spring means for clamping each clamp in at a height within the receiving openings.

13. Workbench according to claim 12, wherein said bench clamp comprises a spring means accommodated in a bore penetrating the bench clamp diametrically and further comprising a ball which protrudes radially out of the bore under pressure of a helical spring, the ball resting against an annular step within the bench-clamp bore, and the helical spring being supported on a closure piece of the bench-clamp bore at an other end thereof.

14. Workbench according to claim 13, wherein the bench clamps have, at one end which protrudes out of the worktop when a workpiece is being clamped, a flattened peripheral region which extends over that height with which the bench clamps protrude to a maximum extent out of the worktop while still maintaining a sufficient bearing in the receiving opening of said worktop under maximum load-bearing capacity.

* * * * *